US007673860B2

(12) United States Patent
Ben-Gigi

(10) Patent No.: US 7,673,860 B2
(45) Date of Patent: Mar. 9, 2010

(54) COMBINATION VISE AND CLAMP

(75) Inventor: Zion Ben-Gigi, Kfar Veradim (IL)

(73) Assignee: Tefentools Ltd., Tefen (IL)

( * ) Notice: Subject to any disclaimer, the term of this patent is extended or adjusted under 35 U.S.C. 154(b) by 338 days.

(21) Appl. No.: 11/452,375

(22) Filed: Jun. 14, 2006

(65) Prior Publication Data

US 2006/0284358 A1 Dec. 21, 2006

(30) Foreign Application Priority Data

Jun. 16, 2005 (IL) ..... 169217

(51) Int. Cl.
*B25B 1/20* (2006.01)

(52) U.S. Cl. ..... 269/41; 269/3; 269/95; 269/246

(58) Field of Classification Search ..... 269/152–155, 269/283, 279, 41, 43, 246, 902, 3, 6, 95
See application file for complete search history.

(56) References Cited

U.S. PATENT DOCUMENTS 3,080,162 A * 3/1963 Smith ..... 269/251
4,305,575 A * 12/1981 Bardes ..... 269/41
4,486,010 A * 12/1984 Haas, Jr. ..... 269/3
5,002,264 A * 3/1991 Nimtz ..... 269/41
5,704,816 A * 1/1998 Polidori ..... 439/781
6,955,344 B2 * 10/2005 Brass et al. ..... 269/45
7,374,158 B2 * 5/2008 Deming ..... 269/41
2003/0136227 A1 7/2003 Pliley
2006/0284358 A1 * 12/2006 Ben-Gigi ..... 269/41
2007/0267796 A1 * 11/2007 Deming ..... 269/41

* cited by examiner

*Primary Examiner*—Lee D Wilson
(74) *Attorney, Agent, or Firm*—Dekel Patent Ltd; David Klein

(57) ABSTRACT

A clamp including a plurality of clamping assemblies, a first of the clamping assemblies including two opposing clamping jaws that have first-shaped clamping surfaces, the clamping jaws being movably mounted on support structure for movement towards and away from each other; and a second of the clamping assemblies including two opposing clamping jaws that have second-shaped clamping surfaces which are shaped differently than the first-shaped clamping surfaces and which are movably mounted on support structure for movement towards and away from each other.

6 Claims, 3 Drawing Sheets

10

28
32
22
16
20
36
18
12
14
36
24
38
16
30
26

COMBINATION VISE AND CLAMP

FIELD OF THE INVENTION

The present invention relates to vises and clamps for clamping and holding workpieces and the like, and particularly to a combination vise and clamp.

BACKGROUND OF THE INVENTION

Vises (also referred to herein as flat-face clamps) are tools with two opposing clamping jaws that have generally parallel, flat faces, which may be used to clamp a workpiece held between the clamping jaws.

Right angle clamps (also referred to as 90 degree clamps) are tools with two opposing clamping jaws, one with a V-shape and the other with X-shaped channels, which may be used to clamp workpieces that must be held at right angles with respect to each other. Vises and right angle clamps are available from a wide variety of manufacturers.

SUMMARY OF THE INVENTION

The present invention seeks to provide a combination vise and clamp, as is described in detail further hereinbelow.

There is thus provided in accordance with an embodiment of the present invention a clamp including a plurality of clamping assemblies, a first of the clamping assemblies including two opposing clamping jaws that have first-shaped clamping surfaces, the clamping jaws being movably mounted on support structure for movement towards and away from each other; and a second of the clamping assemblies including two opposing clamping jaws that have second-shaped clamping surfaces which are shaped differently than the first-shaped clamping surfaces and which are movably mounted on support structure for movement towards and away from each other. The first-shaped clamping surfaces may be generally parallel, flat faces. The second-shaped clamping surfaces may include non-parallel clamping surfaces, such that two workpieces clamped between the non-parallel clamping surfaces are fixed at a non-parallel angle with respect to each other.

The clamp may include one or more of the following features. For example, the clamping assemblies may be arranged back-to-back with respect to one another. The non-parallel clamping jaws may include one clamping jaw with a V-shape and another clamping jaw with X-shaped channels.

In accordance with an embodiment of the present invention one of the clamping jaws of each of the clamping assemblies may be mounted on a threaded shaft (e.g., by means of a threaded support block), wherein rotation of the threaded shaft moves that clamping jaw linearly along the threaded shaft. A handle may be connected to the threaded shaft for rotating the threaded shaft, wherein rotation of the handle moves the clamping assemblies simultaneously.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
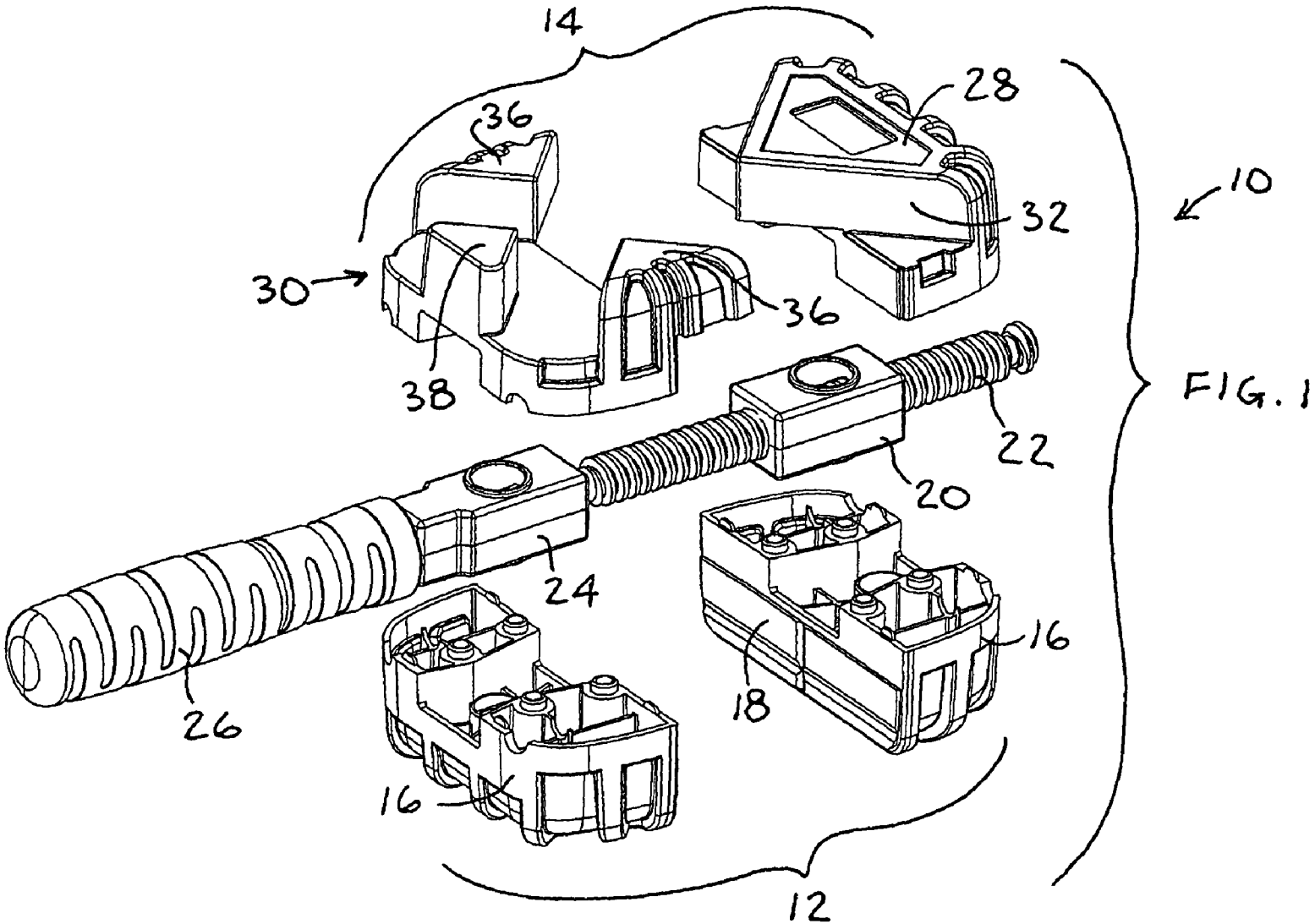
FIG. 1 is a simplified exploded, pictorial illustration of a clamp, constructed and operative in accordance with an embodiment of the present invention.
Figure 2:
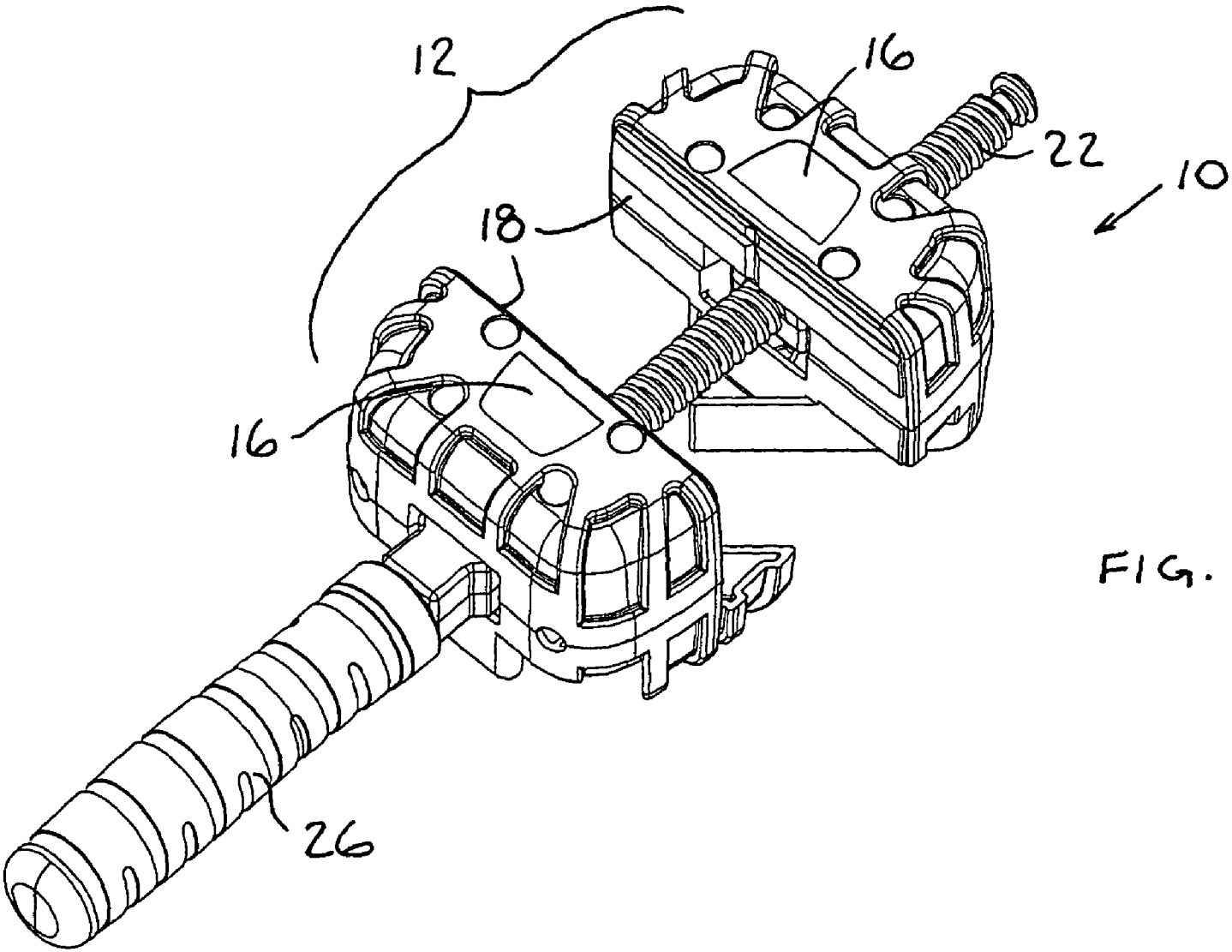
FIG. 2 is a simplified pictorial illustration of the clamp of FIG. 1, showing a first clamping assembly including two opposing clamping jaws that have generally parallel, flat faces.
Figure 3:
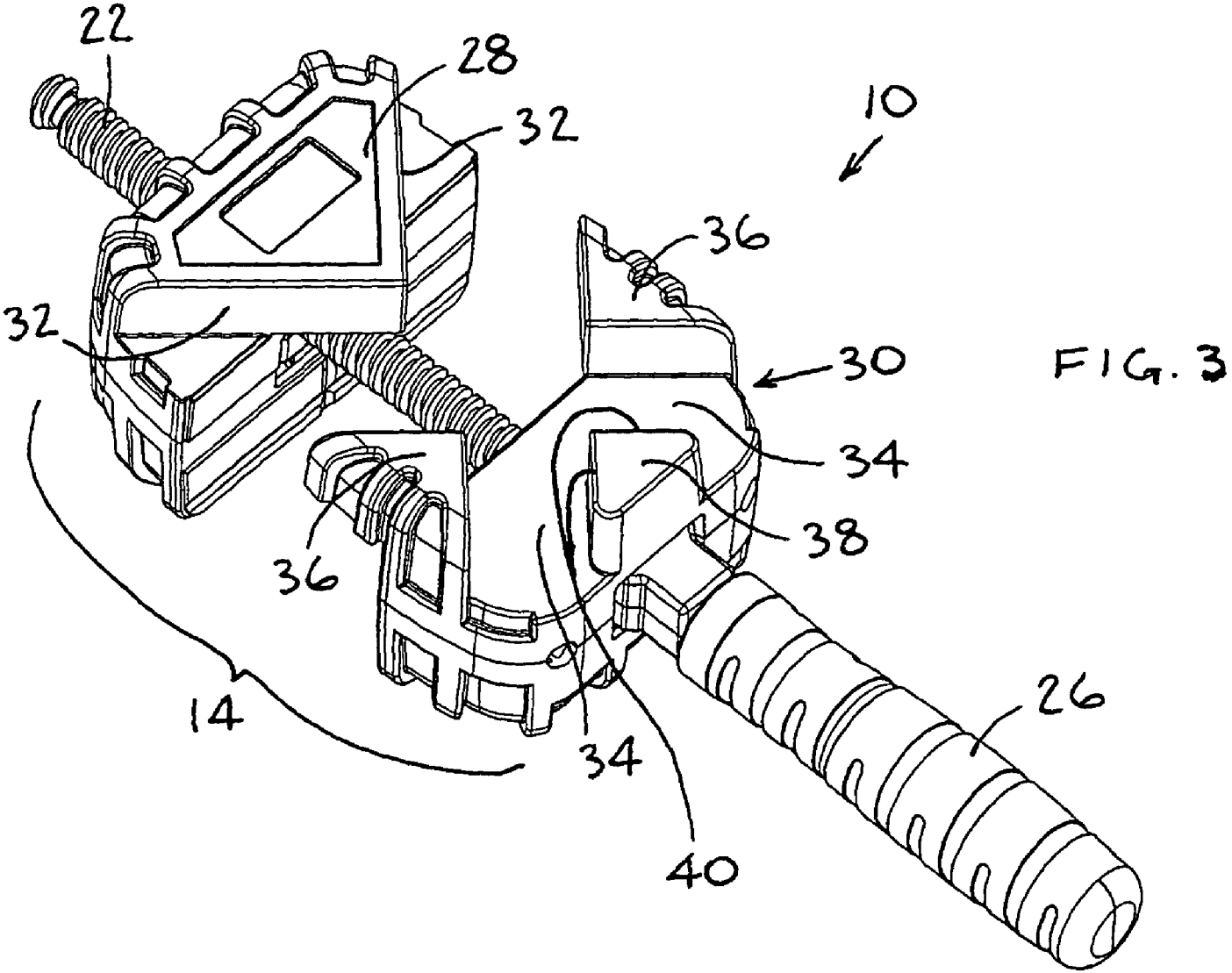
FIG. 3 is a simplified pictorial illustration of the clamp of FIG. 1, showing a second clamping assembly including two opposing non-parallel clamping jaws that have non-parallel clamping surfaces.

Reference is now made to FIGS. 1-3, which illustrate a clamp 10, constructed and operative in accordance with an embodiment of the present invention.

Clamp 10 may include a plurality of clamping assemblies, such as first and second clamping assemblies 12 and 14, respectively, which may be arranged back-to-back with respect to one another. (The invention is not limited to two clamping assemblies and encompasses any plurality of clamping assemblies.) The first clamping assembly 12 may include two opposing clamping jaws 16 that have first-shaped clamping surfaces 18, such as generally parallel, flat faces 18. The clamping jaws 16 may be movably mounted on support structure for movement towards and away from each other. For example, one of the clamping jaws 16 may be mounted on a support block 20 that is threadedly mounted on a threaded shaft 22. The other clamping jaw may be mounted on another support block 24 that remains stationary. A handle 26 may be connected to the threaded shaft 22 for rotating the threaded shaft 22, wherein clockwise rotation of the handle 26 may bring the clamping jaws 16 towards each other and counter-clockwise rotation of the handle 26 may spread the clamping jaws 16 away from each other.

The second clamping assembly 14 may include two opposing clamping jaws 28 and 30 that have second-shaped clamping surfaces (shaped differently than the first-shaped clamping surfaces), such as non-parallel clamping surfaces. For example, clamping jaw 28 may have a V-shape with clamping surfaces 32. Clamping jaw 30 may have X-shaped channels 34, formed by two opposing V-shaped blocks 36 (perpendicular to the V-shaped clamping jaw 28) spaced from one another and spaced from another V-shaped block 38 whose pointed end faces the pointed end of the V-shaped clamping jaw 28. The clamping surfaces 32 of the V-shaped clamping jaw 28 are not parallel with clamping surfaces 40 of the V-shaped block 38. In this manner, two workpieces (not shown) clamped between the non-parallel clamping surfaces are fixed at a non-parallel angle with respect to each other.

The non-parallel clamping jaws 28 and 30 may be movably mounted on support structure for movement towards and away from each other. For example, clamping jaw 28 may be mounted on the support block 20 that is threadedly mounted on a threaded shaft 22. Clamping jaw 30 may be mounted on the other support block 24 that remains stationary. In the illustrated embodiment, handle 26 actuates both first and second clamping assemblies 12 and 14 simultaneously. Accordingly, clockwise rotation of the handle 26 may bring the clamping jaws 28 and 30 towards each other and counter-clockwise rotation of the handle 26 may spread the clamping jaws 28 and 30 away from each other. The invention is not limited to this arrangement, and separate actuators or handles may be provided for independent actuation (movement) of first and second clamping assemblies 12 and 14.

The clamp jaws of first and second clamping assemblies 12 and 14 may be constructed of any suitable material, such as but not limited to, a plastic or metal, and may be provided with non-skid or non-mar jaw pads (which may be made of an elastomer, e.g., natural or synthetic rubber).

It is appreciated that various features of the invention which are, for clarity, described in the contexts of separate embodiments, may also be provided in combination in a single embodiment. Conversely, various features of the invention which are, for brevity, described in the context of a single embodiment, may also be provided separately or in any suitable subcombination.

What is claimed is:

1. A clamp comprising:

a plurality of clamping assemblies, a first of said clamping assemblies comprising two opposing clamping jaws that have first-shaped clamping surfaces, said clamping jaws being movably mounted on support structure for movement towards and away from each other; and a second of said clamping assemblies comprising two opposing clamping jaws that have second-shaped clamping surfaces which are shaped differently than said first-shaped clamping surfaces and which are movably mounted on support structure for movement towards and away from each other, wherein said second-shaped clamping surfaces comprise non-parallel clamping surfaces such that two workpieces clamped between said non-parallel clamping surfaces are fixed at a non-parallel angle with respect to each of said opposing jaws, wherein said non-parallel opposing clamping jaws comprise a first jaw including a V-shape channel and second jaw including X-shape channels, and wherein each of said clamping jaws of said clamping assemblies are actuated along a threaded shaft wherein rotation of said threaded shaft moves said clamping jaws linearly along said threaded shaft.

2. The clamp according to claim 1, wherein said first-shaped clamping surfaces comprise generally parallel, flat faces.

3. The clamp according to claim 1, wherein said clamping assemblies are arranged back-to-back with respect to one another.

4. The clamp according to claim 1, further comprising a handle connected to said threaded shaft for rotating said threaded shaft, wherein rotation of said handle moves said clamping assemblies simultaneously.

5. The clamp according to claim 1, wherein one of the clamping jaws of each of the clamping assemblies is mounted on a support block that is threadedly mounted on said threaded shaft.

6. The clamp according to claim 1, wherein said first-shaped clamping surface comprises a generally flat face, and wherein the clamping jaw with the V-shape comprises a V-shape clamping surface positioned above and protruding further outwards than said flat face.

* * * * *